United States Patent [19]

Loy et al.

[11] 4,009,800

[45] Mar. 1, 1977

[54] FLUID DISPENSER

[75] Inventors: John S. Loy; Melvin C. Hankel; Elmer A. Robbins, all of Fort Wayne, Ind.

[73] Assignee: Tokheim Corporation, Fort Wayne, Ind.

[22] Filed: Sept. 19, 1974

[21] Appl. No.: 507,268

[52] U.S. Cl. ..... 222/28; 222/182; 222/530; 137/355.25; 137/615

[51] Int. Cl.[2] ..... B67D 5/22

[58] Field of Search ..... 222/23, 39, 25–28, 222/34, 36–38, 40, 71–76, 174, 179.5, 182, 530, 527, 463; 137/355.24, 355.25, 615; 239/588

[56] References Cited

UNITED STATES PATENTS

| | | | |
|---|---|---|---|
| 2,225,271 | 12/1940 | Hope | 222/74 |
| 2,345,338 | 3/1944 | Goldberg | 137/355.25 |
| 2,364,138 | 12/1944 | Grise | 222/34 |
| 2,438,698 | 3/1946 | Grise | 222/23 |
| 2,770,499 | 11/1956 | Rapisarda | 137/355.25 |
| 2,896,659 | 7/1959 | Erickson | 222/530 |
| 3,069,051 | 12/1962 | Phillips | 222/71 |
| 3,773,219 | 1/1971 | Irie et al. | 222/76 |
| 3,883,042 | 5/1975 | Junker | 222/74 |

*Primary Examiner*—Robert B. Reeves
*Assistant Examiner*—H. Grant Skaggs

[57] ABSTRACT

A fluid dispenser which includes a stationary, upstanding base and an arm assembly rotatably coupled to the upper end thereof. The dispenser includes a fluid meter and a fluid pump for metering and for pumping a selected quantity of fluid respectively. A fluid dispensing hose is fixedly connected at one end thereof to the pump and meter and has a fluid dispensing nozzle connected to the other end thereof. The hose includes a loop portion which extends outwardly from the arm assembly. A weighted roller is provided for urging the hose into a retracted position within the base.

4 Claims, 8 Drawing Figures

10
18
146
140
142
144
170
172
14
26b
76
16
24
200
13b
74
12
42
44
20
266
82
116
22
48
50
26
52
54
30
28
238
226
230
46
56
59

FIG.4
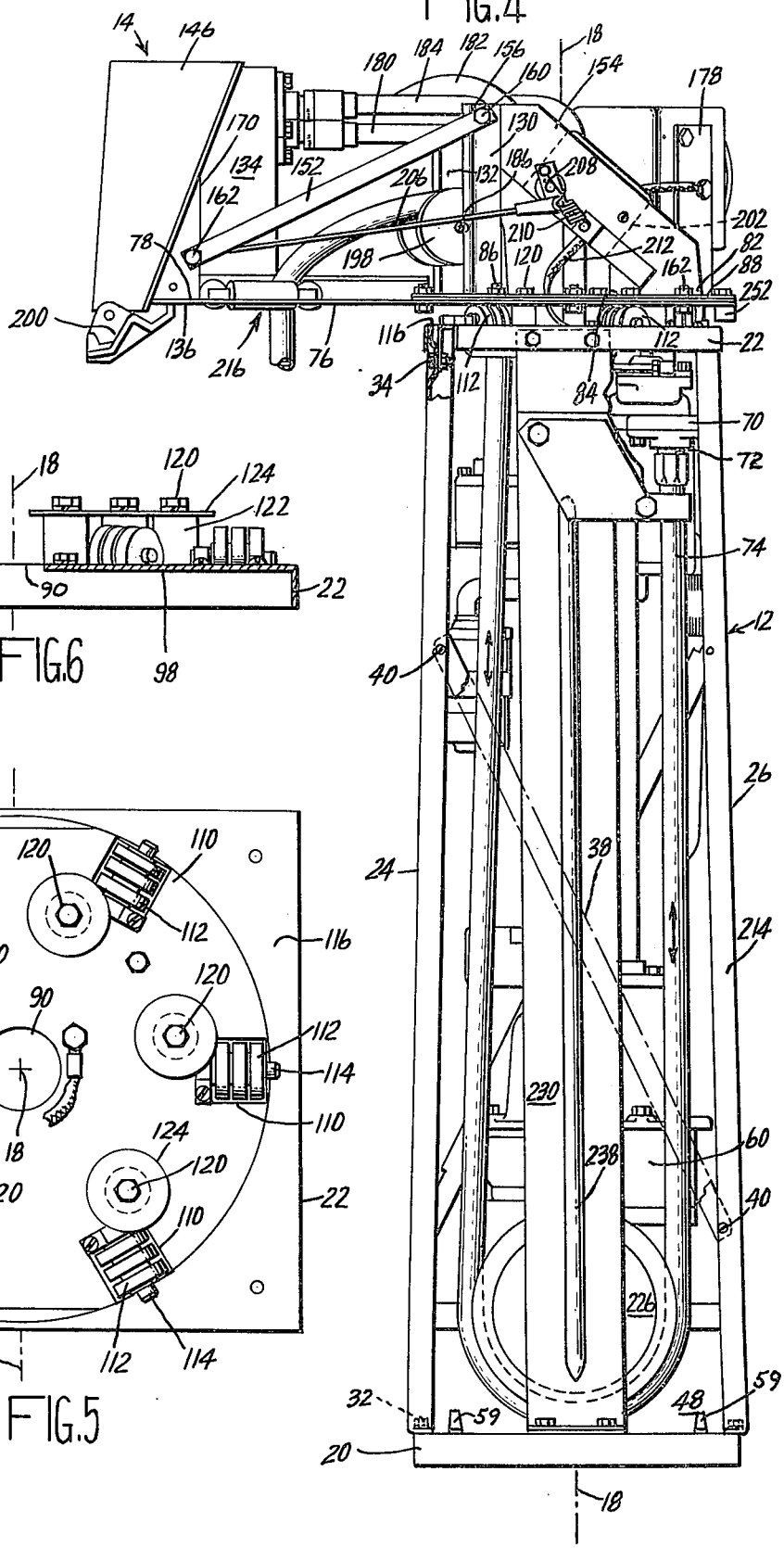
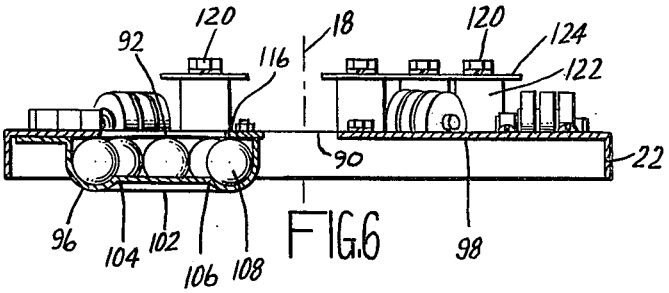
FIG.6
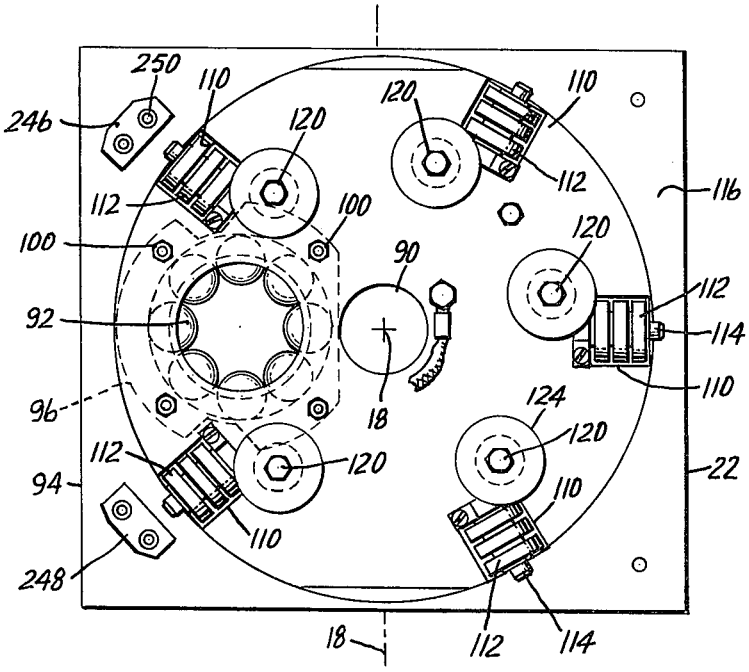
FIG.5

FLUID DISPENSER

BACKGROUND OF THE INVENTION

1. Field of the Invention

The present invention relates to dispensers for a fluid such as gasoline and in particular to such a dispenser which includes a rotatable arm assembly having a fluid dispensing hose extending outwardly therefrom and a simplified hose retracting means which retracts the fluid dispensing hose into a loop configuration within the dispenser.

2. Description of the Prior Art

Fluid dispensers for dispensing fluid such as gasoline, fuel oil, and the like are well-known and over a period of years have experienced a substantial evolution in design. Early manually operated pumps provided with a visually perceptible metering tank have been replaced with motor driven units equipped with mechanical metering devices and more recently digital electronic circuitry has been applied to the metering of the fluids. The general configuration of the pump and wherein the fluid pump, mechanical or other metering means, hose retracting mechanism and the various elements associated with the display of quantity, price and the like, however, has not changed for many years and it is accepted practice to house these elements in a single stationary structure.

It is also common practice to provide a single fluid dispenser with two or more data displays with the dispenser being situated on an island such that it can be used to dispense fluid to vehicles parked on either side of the dispenser. This has, in turn, required a redundancy in the display portions of the dispenser. It is also common for vehicles parked adjacent a dispenser to be parked at varying positions with respect thereto whereby the data display must often be viewed from extreme angles.

Another feature that is typical of contemporary fluid dispensers is the provision of a retractable fluid dispensing hose. Exemplatory of such a retracting mechanism is the widely used cable mechanism which includes a cable secured to dispensing hose and wound upon a spring loaded spool. This particular mechanism is comparatively expensive as a manufactured item. With this mechanism, the dispensing hose is frequently mounted completely externally of the dispenser where it is subject to damage or the maximum extension of the dispensing hose is limited by the particular arrangement of the cable and hose. The cable can also come in contact with a vehicle and cause scratching or marring of the finish thereof.

Efforts to avoid such limitations, costs, and redundancy in a fluid dispenser have not heretofore been satisfactory. Fluid dispensers with a moving arm have required expensive rotary seals. Electrical connections between relatively movable portions thereof have required slip rings or the like. Both of these items further present hazards when used in a dispenser for volatile fluids such as gasoline. The need for a simpler retracting mechanism that will also more fully retract the dispensing hose has also been long recognized.

SUMMARY OF THE INVENTION

Broadly, the present invention is a fluid dispenser which includes a stationary base and a rotatable arm assembly and which is provided with a fluid dispenser hose that is looped within the base and passes outwardly through the arm assembly. A single data display is provided in the arm assembly whereby the arm assembly can be rotated with respect to the base and the dispensing hose extended therefrom to either side. Further, because the dispensing hose is looped within the base of the structure, the hose can be substantially fully retracted within the dispenser.

In a specific embodiment, the retracting mechanism includes a large weighted roller guided by a vertically extending track within the base structure and cradled within the loop portion of the dispenser hose thereby eliminating the need for a separate cable or spring loaded spool retracting mechanism.

In yet another specific embodiment of the invention, the arm assembly is elongated and mounted in cantilevered relationship to the base structure thereby further increasing the maximum extension of the fluid dispensing hose.

The fluid dispensing hose itself includes a loop portion disposed within the base structure and passes upwardly therefrom to the arm assembly and outwardly therefrom. This structure obviates the need for a rotating, fluid tight seal in the fluid dispensing hose between the base structure and arm assembly, the structure permitting the hose to twist through a limited arc to thereby accommodate rotation of the arm assembly.

In another specific embodiment of the invention, the operating controls for initiating operation of the dispenser, resetting the data display elements and the like are mounted to the arm assembly adjacent the radially outwardly disposed end thereof where they are more readily accessible by the user.

In yet another specific embodiment of the invention, the data display includes electronic or electromechanical elements mounted within the head assembly and coupled by electrical conductors to a junction box in the base structure, rotating movement of the head assembly again being accommodated by limited twisting of the electrical cables therebetween.

It is therefore an object of the invention to provide an improved fluid dispenser for pumping and metering selected quantities of a fluid such as gasoline or the like.

It is another object of the invention to provide such a fluid dispenser which includes a rotatable arm assembly.

It is still another object of the invention to provide such a dispenser having the data display mounted in a rotatable arm assembly.

Another object of the invention is to provide such a dispenser which includes a single data display mounted in a rotating arm assembly whereby the data display can be selectively rotated for viewing from any angle.

Another object of the invention is to provide a fluid dispenser which includes a fluid dispensing hose fully retractable into the dispenser.

Still another object of the invention is to provide a fluid dispenser having a rotatable arm assembly and a fixed base structure wherein a fluid dispensing hose extends from the base structure through the head assembly and outwardly therefrom.

It is still another object of the invention to provide such a fluid dispenser wherein relative movement between the base structure and arm assembly thereof is accommodated by limited torsional flexing of the fluid dispensing hose.

Another object of the invention is to provide a fluid dispenser which includes a data display mounted within a rotatable arm assembly with all electrical connections to the data display being provided through twistable conductors extending between the rotatable arm assembly and a fixed base structure.

Yet another object of the invention is to provide a fluid dispenser having a fluid dispensing hose which includes a loop portion received within a fixed base structure and including a dispensing hose retracting mechanism which includes a weighted pulley guided on vertically extending tracks and operatively engaged within the loop portion of the dispensing hose.

Still another object of the invention is to provide a fluid dispenser characterized by its simplified structure, reduced number of components, and reduced manufacturing cost.

The above-mentioned and other features and objects of this invention and the manner of attaining them will be come more apparent and the invention itself will be best understood by reference to the following description of an embodiment of the invention taken in conjunction with the accompanying drawings.

BRIEF DESCRIPTION OF THE DRAWINGS

FIGS. 3 and 4 are side plan views of the fluid dispenser of the present invention shown with the cover panels thereof removed to show interior details thereof;

FIG. 5 is a top plan view showing details of the upper end of the base structure of a dispenser in accordance with the present invention;

FIG. 6 is a side plan view of the end assembly of FIG. 5;

DESCRIPTION OF THE PREFERRED EMBODIMENT

Figures 1, 2:
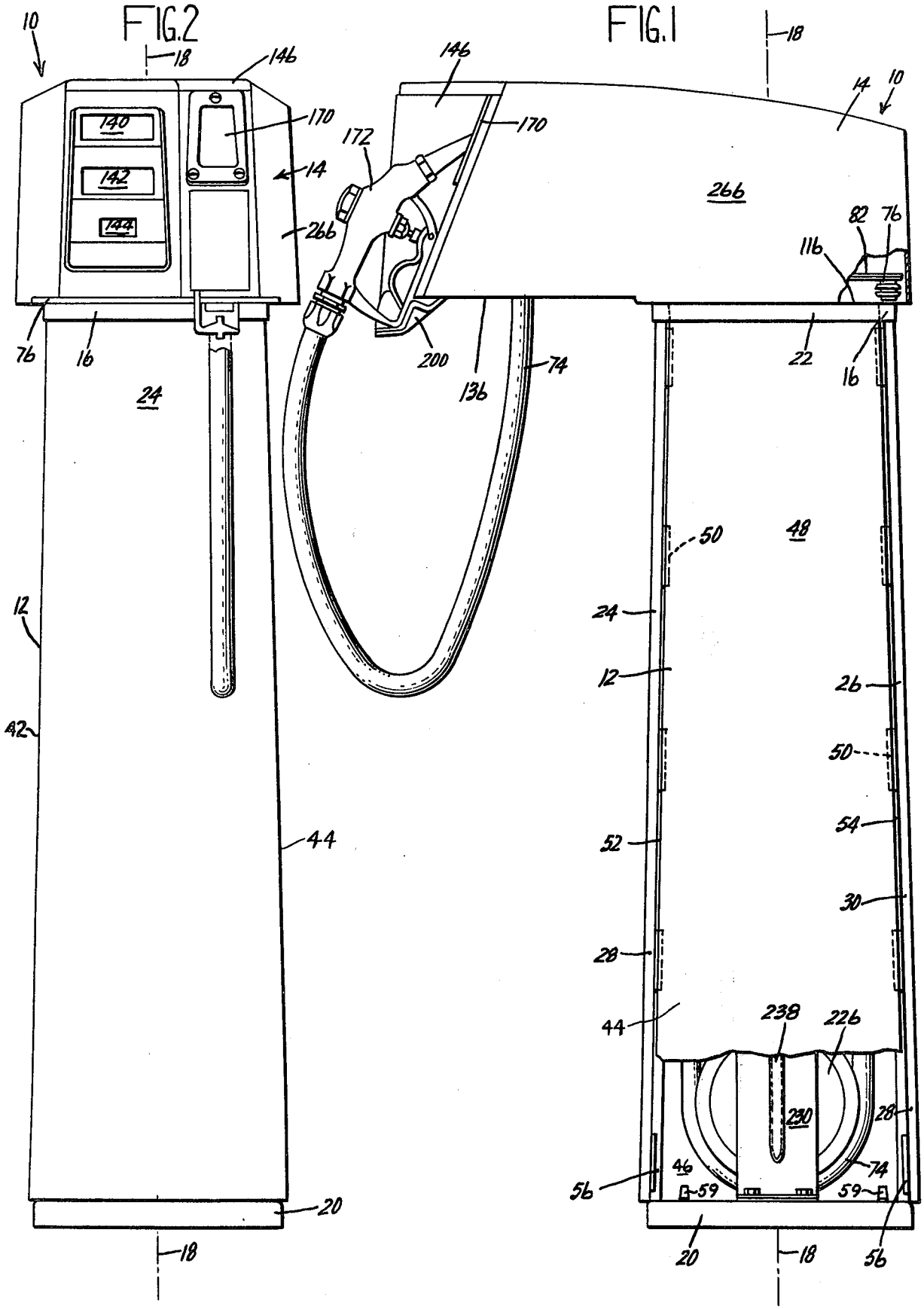
FIG. 1 is a side plan view partially cut-away of a fluid dispenser in accordance with the present invention.
FIG. 2 is a front plan view of the dispenser of the present invention.

Referring now to the drawings, there is shown a fluid dispenser 10 comprising a stationary base structure 12 and an arm assembly 14 which is rotatably mounted to the upper end 16 of base structure 12 for rotation about the vertically extending axis 18 (FIGS. 1 and 2 only) thereof.

Base structure 12 includes a base plate 20 and a top plate 22 made of formed metal plate. Rigid front and back panels 24, 26 are provided with formed longitudinally extending flanges as at 28, 30 for stiffness and are fixedly secured between bottom and top plates 20, 22 by means of suitable threaded fasteners as at 32, 34.

Suitable reinforcing braces 36, 38 are angularly secured between front and back panels 24, 26 by means of suitable threaded fasteners as at 40.

Sides 42, 44 of base structure 12 are closed by means of side panels 46, 48. In a specific embodiment, flanges 28, 30 may be re-entrantly recessed to receive side panels 46, 48 in a flush configuration. Panels 46, 48 are provided with suitable gaskets (FIG. 1 only) along the longitudinal edges 52, 54 thereof. Panels 46, 48 are provided with bottom flanges (not shown) having therein holes that interlockingly engage pins 59 such that panels 46, 48 can be simply and slidably removed from the base structure 12 for access to the internal components of the fluid dispenser 10.

Figure 3:
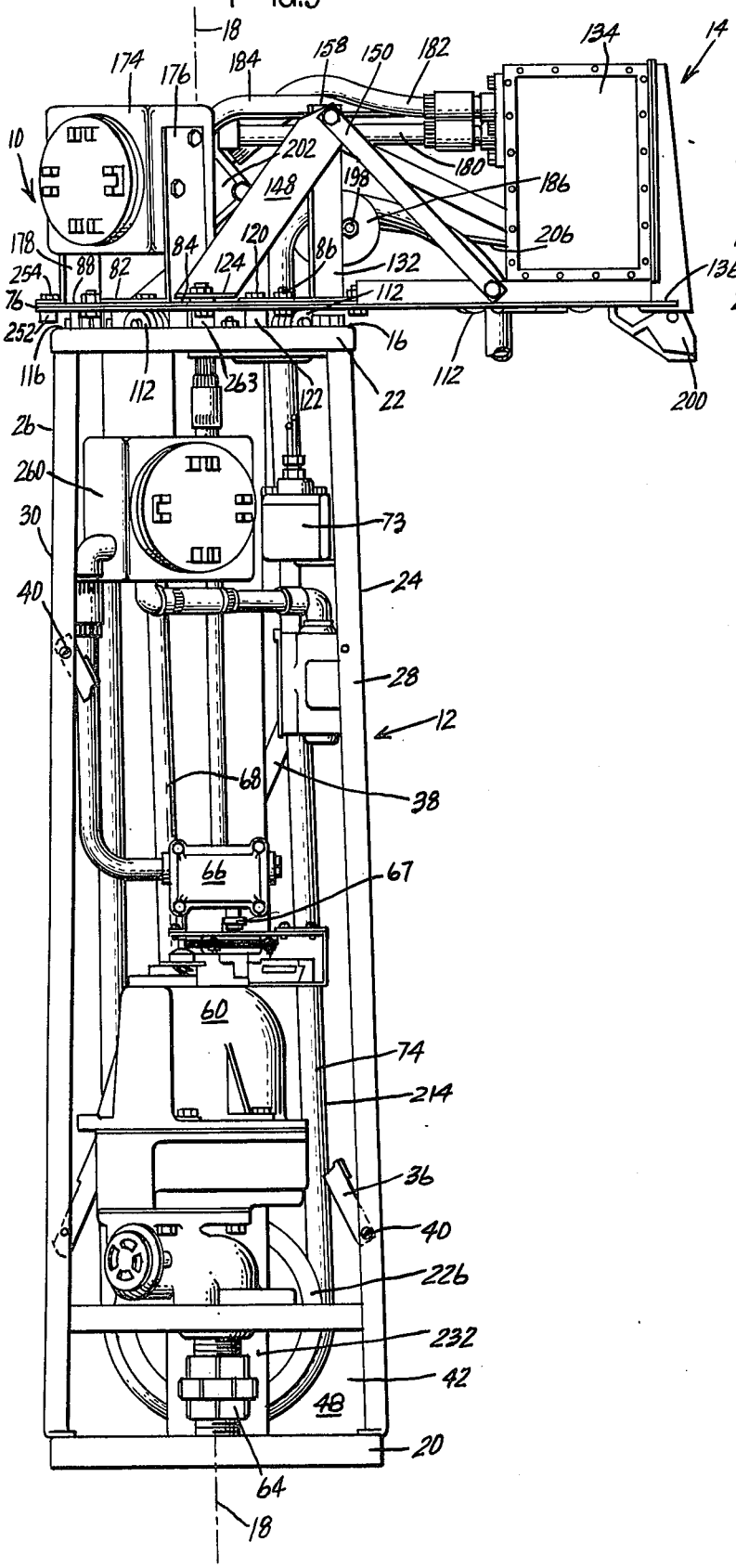
Figure 8:
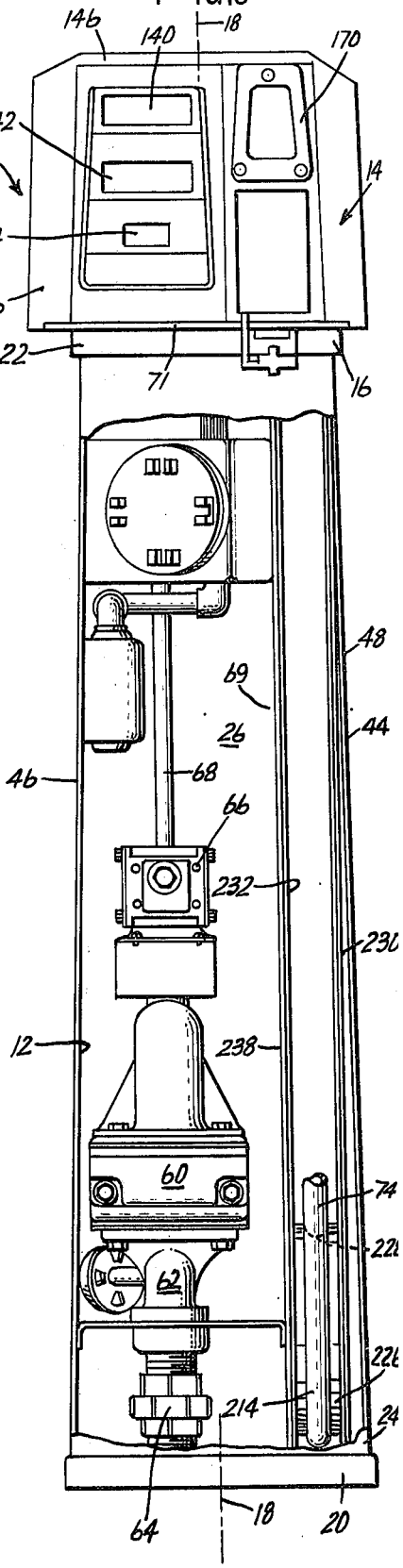
FIG. 8 is a front cut-away plan view of the fluid dispenser of the present invention showing details of the hose retracting mechanism.

As can best be seen in FIGS. 3 and 8, there are enclosed within base structure 12 conventional components associated with a fluid dispenser. These components include an electrically controlled positive displacement fluid pump 60 which is coupled to a fluid reservoir (not shown) through a strainer and check valve 62 and a conventional pipe fitting 64. A pulser 66 which generates an electrical pulse in response to the flow of a predetermined incremental quantity of fluid therethrough is mechanically coupled by a shaft 67 to pump 60, fluid passing through a fluid pipe 68 to a conventional dispenser valve 70 operated by solenoid valve 73. Valve 70 has an outlet fitting 72 to which is fixedly connected a flexible, fluid dispensing hose 74.

As can best be seen in FIG. 8, components 60, 62, 64, 66 and 68 are mounted in generally vertical array to left of axis (as viewed in FIG. 8) thereby leaving a generally open space 69 to the right (as viewed in FIG. 8) within base structure 12.

Figure 7:
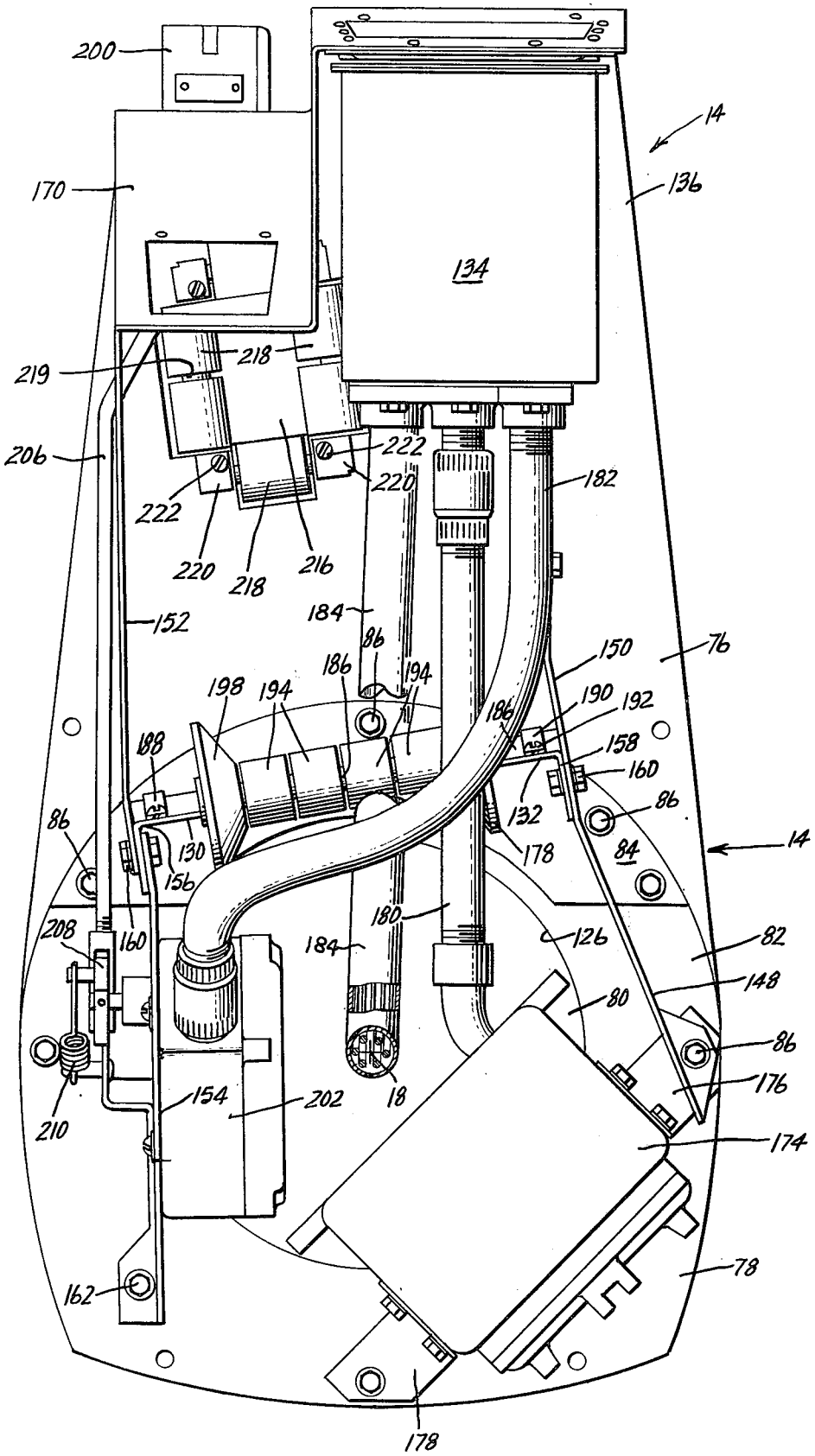
FIG. 7 is a top plan view of the arm assembly for use in the present invention.

As can best be seen in FIGS. 3, 4 and 7, arm assembly 14 includes a rigid base member 76 which may be made of a plurality of laminations of metal plate fixedly secured together by means of threaded fasteners, spot welding or the like. Member 76 is elongated and is provided at its end 78 with a circular opening 80. Member 76 may further be provided with reinforcing plates as at 82, 84 secured to member 76 by means of threaded fasteners 86. The top surface 88 of reinforcing members 82, 84 and the bottom surface of base member 76 are smooth adjacent opening 80.

As can best be seen in FIGS. 5 and 6, top plate 22 is provided with a circular opening 90 through the center thereof and with a larger circular opening 92 therethrough disposed between opening 90 and the front edge 94 of plate 22. A circular, flanged cup 96 is secured to the under surface 98 of plate 22 by threaded fasteners 100. A circular hole 102 is provided through cup 96, hole 102 being disposed in registry with hole 92. The circumferial edge 104 of hole 102 is upturned as at 106 and a plurality of spherical balls 108 are captively retained between cup 96 and plate 22 in a position wherein portions of the balls 108 extend radially inwardly of the hole 92. It will be seen that the balls 108 provide a low friction sliding bearing for fluid dispensing hose 74 which, as will be explained below, extends upwardly through the hole 92.

As can best be seen in FIG. 5, a plurality of rectangular openings 110 are formed in end plate 22 in positions equally radially displaced from the axis 18. Within each opening 110 is secured a plurality of rollers as at 112, rollers 112 being rotatably mounted on suitable axles 114 in positions wherein rollers 112 extend vertically above the top surface 116 of plate 22. A plurality of shoulder bolts 120 are threadingly secured to the upper surface 116 of plate 22 adjacent each opening 110. Rotatably received on each of the shoulder bolts 120 is a roller 122 and a retaining disc 124, disc 124 having a diameter larger than the diameter of the rollers 122.

As can best be seen in FIGS. 3 and 4, member 76 is supported in parallel, spaced-apart relationship above plate 22 on rollers 112 with rollers 122 being received upwardly through opening 80. Rollers 122 engage the inner surface 126 of opening 80 and discs 124 overlie top surface 88 of reinforcing plates 82, 84. It will now be seen that member 76, by reason of its securement to the base structure 12, is able to rotate with respect thereto about the axis 18.

Upstanding legs 130, 132 each having an L-cross-section are fixedly secured to member 76 in upstanding relationship thereto adjacent opening 80. A sealed enclosure 134 is mounted adjacent the distal end 136 of member 76. Enclosure 134 encloses conventional data display means (not shown) for indicating data such as the quantity of fluid dispensed, price per unit, volume of fluid, and total price of the sale. The data display means may take any of a variety of configurations well known to those skilled in the art. The data display includes conventional visual display elements 140, 142, 144 which face outwardly from axis 18. Preferably, data display elements 140, 142 and 144 are provided with a light shield 146 (FIGS. 1, 4 and 8 only) to enhance visibility of the data display elements in high ambient light conditions. The data display means is operated electrically or electronically in response to pulse signals from the pulser 66.

A plurality of braces 148, 150 and 152, 154 are fixedly secured between the upper ends 156, 158 of legs 130, 132 and member 76 by means of suitable threaded fasteners as at 160, 162. A conventional fluid dispensing nozzle receptacle 170 is secured to the distal end 136 of member 76, receptacle 170 removable receiving a conventional fluid dispensing nozzle 172 (FIG. 1 only). A sealed electrical junction box 174 is also fixedly secured to member 76 by means of a pair of upstanding legs 176, 178. An electrical conduit 180, 182 extending between enclosure 134 and junction box 174.

An axle 186 is mounted horizontally between legs 156, 158 by means of suitable brackets 188, 190 and threaded fasteners as at 192. A plurality of cylindrical rollers 194 are rotatably received on axle 186 between a pair of conical rollers 198, the diameter of conical rollers 198 being larger than the diameter of rollers 194 as can best be seen in FIG. 7.

An operating lever 200 is pivotally coupled to member 76 adjacent end 136 thereof, operating lever 200 being operatively engaged with fluid dispensing nozzle 172 when the latter is in its stored position as shown in FIG. 1. Operating lever 200 functions to reset the data display means within enclosure 134 and otherwise to initiate dispenser 10 for operation. To effect the resetting and initiating operations, an explosion proof switch means 202 is pivotally mounted to base 154 and is operatively coupled to operating lever 200 by means of a suitable connecting link 206. Link 206 is in turn connected to a bell crank 208 fixedly coupled to enclosure 202, bell crank 208 being spring biased by spring 210. Arm assembly 14 and base structure 12 are electrically coupled by means of a ground strap 212.

Fluid dispensing hose 74 is seen to include a loop portion 214 which is received within the open portion 69 of base structure 12. Hose 74 extends upwardly from base structure 12 through opening 92, over rollers 194 and outwardly through an opening 216 in distal end 136 of member 76. Opening 216 is rectangular and bounded by a plurality of rollers 218, the latter being rotatably secured to member 76 by means of axles 219, suitable brackets 220, and threaded fasteners 222. Rollers 218 again provide a sliding bearing for fluid dispensing hose 74.

To provide a means for urging hose means 74 into a retracted position within base structure 12, there is provided a large, weighted roller 226 made of cast iron or the like material. Roller 226 has a circumferential groove (FIG. 8 only) in the circumference thereof to engage hose 74. A pair of elongated track members 230, 232 are fixedly secured in parallel, spaced-apart relationship between upper and lower plates 22, 20. The spacing between members 230, 232 is dimensioned to slidably receive roller 226 therebetween. Each of members 230, 232 has formed adjacent the center line thereof an elongated reinforcing rib 238, extending substantially the full length of the members 230, 232. It will now be seen that roller 226 can move vertically upwardly and downwardly between members 230, 232, roller 226 being maintained therebetween the loop portion of hose 74. It will further be observed that vertical movement of roller 226 will occur in response to a pulling force applied outwardly on hose 74 when the latter is manually extended outwardly from dispenser 10. It will further be observed that, because hose 74 is flexible and by reason of the width of rollers 194, simple torsional flexing of hose 74 accommodates relative movement between assembly 14 and base structure 12. This movement will apply nominal stress to hose 74. To prevent arm assembly 14 from being rotated continuously in one direction and thereby causing possible damage to hose 74, a pair of stop abutment members 246, 248 are fixedly secured to the top surface 116 of plate 22 by suitable threaded fasteners as at 250 and a stop pin 252 is fixedly secured to member 76 by threaded fastener 254 such that member 252 abutingly engages elements 246, 248. This limits the arc through which arm assembly 14 can be rotated about axis 18. Additional stop pins may be employed and/or pin 252 moved to limit the arc as desired.

Similarly, electrical connections between junction box 260 mounted within base structure 12 and junction box 174 mounted to arm assembly 14 are effected by flexible wires received within conduit 262. Conduit 262 is provided with a slip bearing 263 to accommodate twisting thereof. Arm assembly 14 is enclosed within a decorative cover 266.

From the above description it will be seen that the fluid dispenser 10 of the present invention which includes an arm assembly rotatably mounted to a stationary base structure affects a number of improvements over prior art fluid dispensers. The fluid dispenser of the present invention enables a single data display means mounted in the rotatable arm to be used for dispensing fluid from both sides of the dispenser. The elongated arm assembly increases the maximum extension of the fluid dispensing hose. The dispenser does not require any sliding seals or rotary fluid seals between the stationary base structure 12 and rotating arm assembly 14, accommodation of relative movement being provided by flexing of the electrical conductors and the fluid dispensing hose. The retracting mechanism for the fluid dispensing hose is substantially simpler to the prior art devices and permits maximum hose extension from the dispenser. The present structure further locates the operation lever for resetting the display means and initiating operation of the pump conveniently with respect to the dispensing nozzle receptacle. The present fluid dispenser further enables greater latitude in the design and thereby the appearance of the dispenser. All functional parts of the dispenser, that is all of the components that function to a pump, meter, and otherwise control the dispensing of the fluid are conventional components well-known to those skilled in the art. The pulser, data display means and the like can be any conventional fluid dispensing metering means, it only being required that these elements be mounted in the explosion proof enclosures in accordance with the explosion proof construction requirements of Underwriters Laboratories, Inc.

While there have been described above the principles of this invention in connection with specific apparatus, it is to be clearly understood that this description is made only by way of example and not as a limitation to the scope of the invention.

What is claimed is:

1. In a fluid dispenser which includes means for pumping, means for metering, and means for controlling the dispensing of a selected quantity of fluid, the combination comprising a base structure having upper and lower ends and enclosing said pumping and metering means, an arm assembly and bearing means pivotally mounting said arm assembly to said upper end for rotating movement through a predetermined arc about a vertical axis, a fluid dispensing hose connected at one end thereof to said pumping and metering means, said hose being coupled to and extending outwardly from the distal end portion of said arm assembly, electrically operable display means for visually displaying the quantity, price per unit volume, and total price of fluid dispensed, said display means being fixedly mounted in said arm assembly, a plurality of flexible electrical conductors extending between said base structure and said arm assembly and operatively coupling said display means to said metering means, junction boxes fixedly mounted in said base structure and said arm assembly, respectively, a conduit connected between said junction boxes and having a slip bearing therein, portions of said conductors extending between said junction boxes through said conduit, rotational movement of said arm assembly being accommodated by twisting of said conductors within said conduit.

2. In a fluid dispenser which includes means for pumping, means for metering, and means for controlling the dispensing of a selected quantity of fluid, the combination comprising a base structure having upper and lower ends and enclosing said pumping and metering means, an arm assembly and bearing means pivotally mounting said arm assembly to said upper end for rotating movement through a predetermined arc about a vertical axis, a fluid dispensing hose connected at one end thereof to said pumping and metering means, said hose being coupled to and extending outwardly from the distal end portion of said arm assembly, display means including a digital display panel for visually displaying the quantity, price per unit volume, and total price of fluid dispensed, said display means being fixedly mounted in said distal end portion of said arm in a position facing radially outwardly of said axis, a plurality of flexible electrical conductors extending between said base structure and said arm assembly and operatively coupling said display means to said metering means, rotational movement of said arm being accommodated by twisting of said conductors, means for urging said hose into a retracted position within said base, said base structure including a top cover having a first opening therethrough, first sliding bearing means secured to said cover in registry with said opening for slidingly guiding said hose therethrough, a second opening in the bottom of said arm assembly and being shaped and dimensioned such that a portion of said second opening is in registry with said first opening at all rotational positions of said arm assembly, an elongated roller assembly rotatably mounted to said arm assembly adjacent said second opening, a third opening in said arm distal portion, second sliding bearing means mounted to said arm assembly in registry with said third opening for slidably guiding said hose therethrough, said hose passing through said first and second openings over said roller, and outwardly through said third openings.

3. In a fluid dispenser which includes means for pumping, means for metering, and means for controlling the dispensing of a selected quantity of fluid, the combination comprising a base structure having upper and lower ends and enclosing said pumping and metering means, an arm assembly and bearing means pivotally mounting said arm assembly to said upper end for rotating movement through a predetermined arc about a vertical axis, a fluid dispensing hose connected at one end thereof to said pumping and metering means, said hose being coupled to and extending outwardly from the distal end portion of said arm assembly, said base structure including a top plate and said arm assembly including a bottom plate, said top and bottom plates being disposed in parallel, spaced-apart relationship and said bottom plate having a circular opening therein disposed above said top plate, said bearing means including a first circular array of rollers mounted to said top plate for rotation about radii of said axis, a second circular array of rollers mounted to said top plate for rotation about axes parallel to said axis, said first array of rollers engaging the under surface of said bottom plate, said second array of rollers engaging the wall of said opening, and further including a plurality of retaining elements mounted to said top plate and slidably interlockingly engaging the top surface of said bottom plate.

4. In a fluid dispenser which includes means for pumping, means for metering, and means for controlling the dispensing of a selected quantity of fluid, the combination comprising a base structure having upper and lower ends and enclosing said pumping and metering means, an arm assembly and bearing means pivotally mounting said arm assembly to said upper end for rotating movement through a predetermined arc about a vertical axis, a fluid dispensing hose connected at one end thereof to said pumping and metering means, said hose being coupled to and extending outwardly from the distal end portion of said arm assembly, said hose including a loop portion disposed within said base structure, and further including means for retracting said hose into a stored position within said base structure, said retracting means including gravity responsive means for increasing the dimensions of said loop portion to thereby urge said hose into a retracted position within said base structure, said hose being extendable from said base structure in response to a tensive force on said distal end thereof sufficient to overcome the force generated by said gravity responsive means.

* * * * *